US007316195B2

(12) United States Patent
DeHart

(10) Patent No.: US 7,316,195 B2
(45) Date of Patent: Jan. 8, 2008

(54) DRAIN PLUG RETENTION SYSTEM

(75) Inventor: Brent DeHart, Draper, UT (US)

(73) Assignee: Thin Air, Inc., Salt Lake City, UT (US)

( * ) Notice: Subject to any disclaimer, the term of this patent is extended or adjusted under 35 U.S.C. 154(b) by 0 days.

(21) Appl. No.: 11/133,151

(22) Filed: May 18, 2005

(65) Prior Publication Data

US 2006/0260525 A1 Nov. 23, 2006

(51) Int. Cl.
*B63B 13/00* (2006.01)

(52) U.S. Cl. ..... 114/197

(58) Field of Classification Search ..... 114/197, 114/198

See application file for complete search history.

(56) References Cited

U.S. PATENT DOCUMENTS

| | | | | |
|---|---|---|---|---|
| 3,812,810 | A | 5/1974 | Moeller | |
| 4,216,558 | A | 8/1980 | Schultz | |
| 4,516,515 | A | 5/1985 | Johnson | |
| 4,843,376 | A | 6/1989 | Wagner et al. | |
| 4,930,657 | A * | 6/1990 | Walker | 220/235 |
| 4,986,502 | A | 1/1991 | Ceroke | |
| 5,460,111 | A | 10/1995 | Frahn | |
| 5,806,380 | A | 9/1998 | Wilsey | |
| 5,966,080 | A | 10/1999 | Bigsby | |
| 6,035,800 | A * | 3/2000 | Clifford | 114/347 |
| 6,227,132 | B1 | 5/2001 | Garcia | |
| 6,928,943 | B1 * | 8/2005 | Neubauer | 114/197 |

OTHER PUBLICATIONS

"Boat Owners World" internet, www.boatownersworld.com/teknautica/plugrench.htm, Feb. 9, 2005, 1-2, US.

* cited by examiner

*Primary Examiner*—Jesús D Sotelo
(74) *Attorney, Agent, or Firm*—Thorpe North & Western LLP

(57) ABSTRACT

Disclosed is a drain plug retention system comprising a drain plug configured to open and close a drain hole located in the transom of a boat; a drain plug wrench configured to facilitate the removal and restoration of the drain plug with respect to the drain hole; and a floatation device configured to receive and to buoyantly support the drain plug wrench and the drain plug.

17 Claims, 4 Drawing Sheets

DRAIN PLUG RETENTION SYSTEM

FIELD OF THE INVENTION

The present invention relates to drain plugs and drain plug wrenches, and more particularly to a drain plug retention system comprising, in part, means for removing the drain plug and means for retaining the drain plug, once removed.

BACKGROUND OF THE INVENTION AND RELATED ART

It is standard practice in the manufacture of almost all recreational and other boats that are designed to be repeatedly removed from the water for storage or transport, such as sailboats, motorboats, and some fishing boats, to include a drain hole formed in their transom. The purpose of a drain hole is to permit drainage of bilge water. The drain hole is typically located near the lower portion of the transom and somewhat proximate the boat hull. The purpose of the drain hole is to facilitate water removal from the boat either when removed from the water altogether, or at speeds when the water is incapable of entering into the boat through the drain hole.

A boat plug or drain plug is used to selectively open and close the drain hole, and is configured to seal the drain hole prior to placing the boat into the water, thus preventing water from flowing into the boat. When such a drain plug is not properly installed, water can quickly flow into the boat through the drain hole, possibly sinking the boat, or at least decreasing the performance of the boat depending upon the amount of water allowed to enter the boat.

There are several different types of drain plugs, with perhaps the most common drain plug being made of a non-corrosive metal and comprising a lower end portion and an upper head. The lower end portion comprises externally threaded cylindrical sidewalls configured to be inserted or screwed into the drain hole or into a drain hole insert fittable within the drain hole designed to receive the drain plug. The upper head is typically square, similar to a bolt head, so as to be able to receive a wrench for easy removal and securing of the drain plug. Drain plugs often have a square end, similar to a bolt head, opposite the threaded end and can be installed and removed with a wrench.

One of the more common problems associated with drain plugs is that they are easily lost or misplaced. Because drain plugs are relatively small, often measuring less than an inch in length and diameter, it is not uncommon for boat owners to lose or misplace these at some point. Thus, while a drain hole and drain plug provide a simple and effective solution to the problem of removing bilge water from a boat, there remains the problem of what to do with the drain plug when it is not in use. Prior related devices or systems have attempted to solve this problem by providing means designed to tether the drain plug to the transom of the boat. The problem with tethering the drain plug to the transom is that the tether is typically located adjacent and drain hole and is therefore out of sight. While this helps to keep track of the drain plug, the boat owner still must remember to remove and/or secure the drain plug as there is nothing to remind the boat owner of this task. Indeed, although providing a drain hole is important for the reasons discussed above, one of the more significant problems is remembering to remove and/or secure the drain plug at the appropriate times. Other systems or devices have attempted to solve the problem by providing a wrench that is capable of removably receiving and securing the drain plug to its body or other portion. However, coupling the drain plug to the wrench, without more, does little to solve the problem as the wrench is typically stored in a tool box or other container out of sight, or may itself get lost or misplaced.

A more significant problem associated with drain plugs is forgetting to remove and/or secure the drain plug at the appropriate time. Due to their small size and the rather discrete, but necessary, location of the drain hole designed to receive the drain plug, it is not uncommon for boat owners to forget to either remove the drain plug upon removing the boat from the water, or worse, to replace or secure the drain plug in the drain hole prior to launching the boat into the water. Each of these inadvertent acts can be costly to the boat owner. For instance, launching a boat without the drain plug properly secured in the drain hole will cause the boat to quickly fill with water and possibly sink. On the other hand, if the drain plug is not removed when the boat is taken out of the water, there runs a risk of damaging the boat.

Based on the foregoing, in order to prevent the risk of sinking a boat upon launching and to prevent damage to a boat or its contents when the boat is out of the water, it is desirable to provide a system for reminding a boat owner to install or remove the drain plug from the drain hole at the appropriate times. It is also desirable to provide a system for facilitating the removal and securing of the drain plug, as well as for retaining the drain plug when not in use.

SUMMARY OF THE INVENTION

In light of the problems and deficiencies inherent in the prior art, the present invention seeks to overcome these by providing a drain plug retention system configured to retain the drain plug once removed, and to remind or make aware the user of the status of the drain hole.

In accordance with the invention as embodied and broadly described herein, the present invention features a drain plug retention system comprising: (a) a drain plug configured to open and close a drain hole located in the transom of a boat; (b) a drain plug wrench configured to facilitate the removal and restoration of said drain plug with respect to said drain hole; and (c) a floatation device configured to receive and to buoyantly support said drain plug wrench and said drain plug.

In another aspect, the present invention features a drain plug retention system comprising: (a) a drain plug configured to open and close a drain hole located in the transom of a boat; (b) a drain plug wrench configured to facilitate the removal and securing of the drain plug with respect to the drain hole, the drain plug wrench further comprising means for retaining and supporting the drain plug once removed from the drain hole; and (c) means for grouping the drain plug wrench and retained drain plug with a boat key to increase the locality of the drain plug and to remind a boat user of the whereabouts and status of the drain hole.

In still another aspect, the present invention features a drain plug retention system comprising: (a) a floatation device; (b) a recess formed in the floatation device; and (c) a threaded insert fittable within the recess, the threaded insert configured to releasably retain a drain plug once removed from a drain hole of a boat.

The present invention further features a method for reminding a boat owner of the status of a drain hole of a boat. The method comprises: (a) providing a drain hole formed in a transom of the boat; (b) providing a drain plug configured to open and close the drain hole; (c) facilitating the removal of the drain plug using a drain plug wrench; and (d) supporting the drain plug about a floatation device.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 7-B illustrates a perspective view of a drain plug wrench comprising still another alternative configuration; and FIG. 7-C illustrates a perspective view of a drain plug wrench comprising still another alternative configuration.

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 7-C, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for facilitating the removal of a boat or drain plug from a drain hole (or drain plug insert that is fittable within a drain hole and which is essentially the equivalent of a drain hole) located in the transom of a boat, for retaining the drain plug, once removed, in a viewable location likely to signal and remind the boat owner of the plug's absence from the drain hole or drain hole insert, and for facilitating the restoration of the drain plug to its proper secured place within the drain hole or drain hole insert when desirable to do so.

Figure 1:
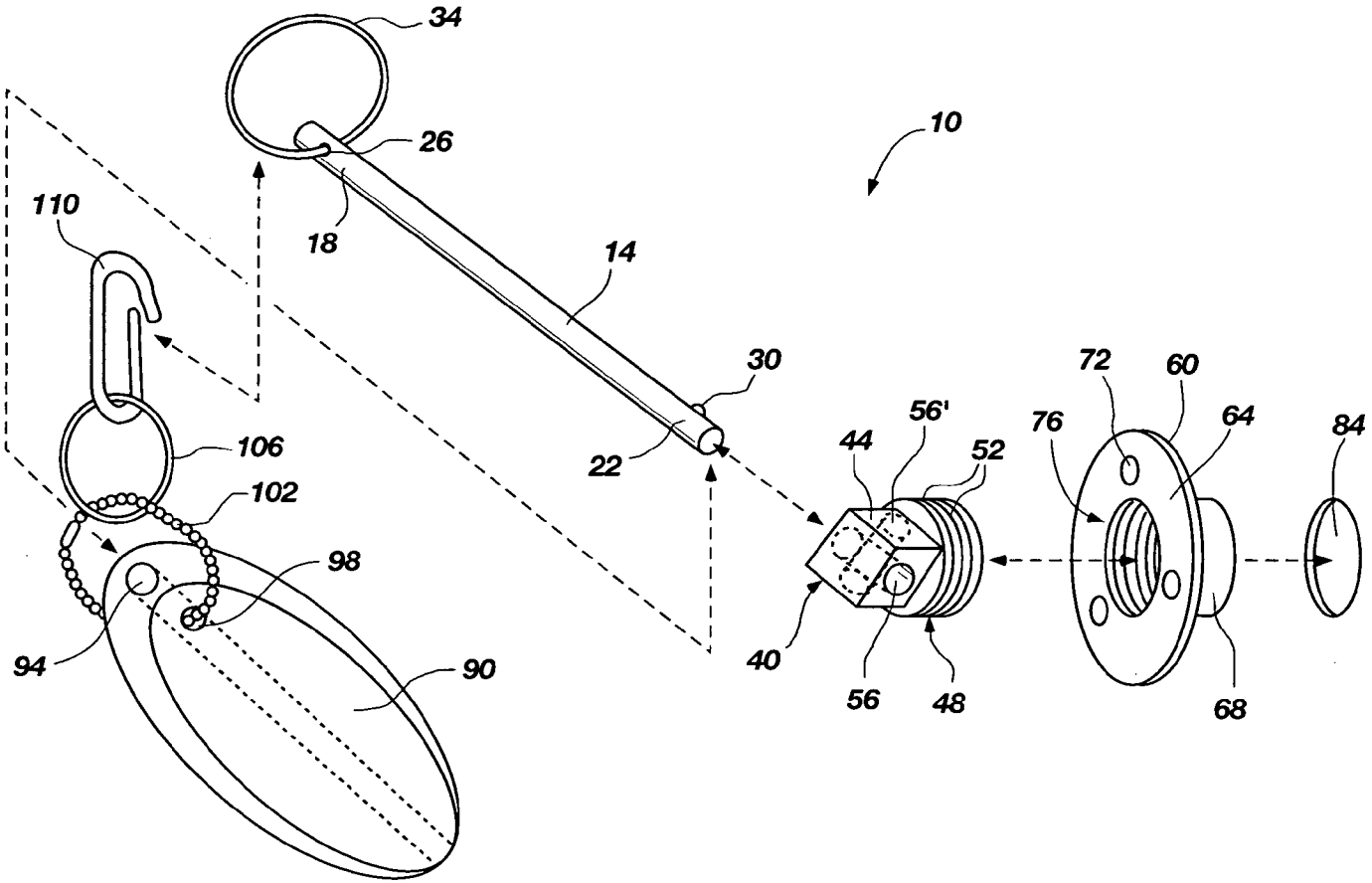
FIG. 1 illustrates an exploded perspective view of the drain plug retention system according to one exemplary embodiment of the present invention.

With reference to FIG. 1, illustrated is an exploded perspective view of a drain plug retention system according to one exemplary embodiment of the present invention. Specifically, FIG. 1 illustrates the drain plug retention system 10 as comprising a drain plug wrench 14 in the form of a bar or rod that functions much like a crank arm when engaged with a drain plug 40 (commonly known as a garboard drain plug). The drain plug wrench 14 comprises a first end 18, a second end 22, and a circular cross-section, although this is not to be limiting as other cross-sections are contemplated. The drain plug wrench 14 is sized and configured to fit into or through a corresponding or complementary bore 56 that is formed in the upper head portion 44 of the drain plug 40. The upper head portion 44 may comprise multiple bores, shown as bore 56 and bore 56' indicated by the dotted lines. Bores 56 and 56' are shown as being orthogonal to one another, although this is not necessary. In addition, the drain plug wrench 14 is not limited to comprising one or two bores. Indeed, any number of bores may be formed in the upper head portion 44, and at any orientation with respect to one another. In addition, the upper head portion 44 may comprise other geometric configurations other than a cube, such as a cylinder.

The drain plug wrench 14 may be removably inserted through either of the bores 56 and 56' of the drain plug 40, or in other words may releasably engage the drain plug 40, in order to facilitate both the removal and replacement or securing of the drain plug 40 with respect to the threaded bore 76 of the drain hole insert 60 (or a drain hole itself if appropriately configured to receive a drain plug). The drain hole insert 60 comprises a base flange 64 and a sleeve 68 extending therefrom. The sleeve 68 is sized and configured to fit within a drain opening 84 formed in a transom 80 of a boat (not shown), as indicated by the dotted lines and corresponding directional arrows.

Figure 5:
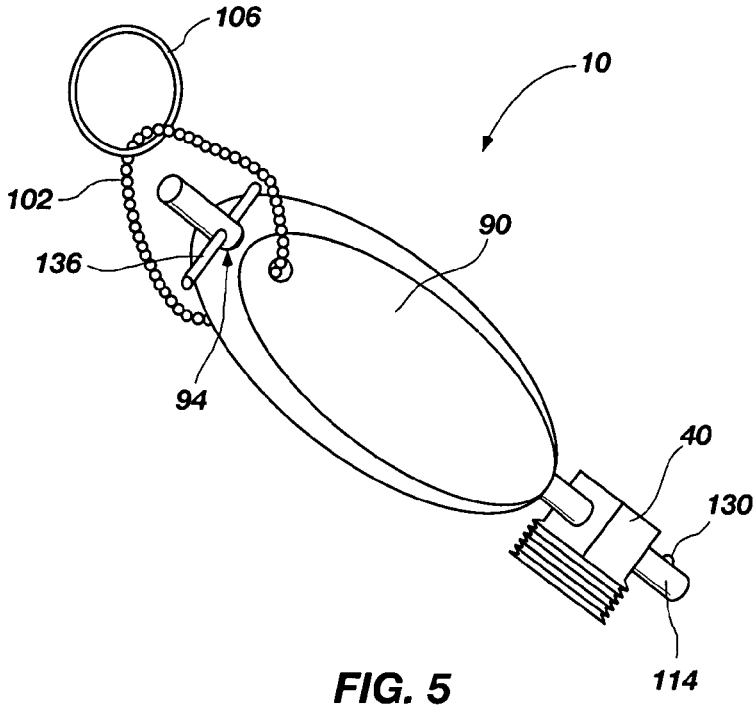
FIG. 5 illustrates a perspective view of an assembled drain plug retention system according to another exemplary embodiment of the present invention.

The drain plug wrench 14 may further comprise in its first end 18 stop means. In the embodiment shown in FIG. 1, the stop means comprises an aperture 26 configured to receive and secure a key ring 34 or other coupling member therethrough. The key ring 34 provides at least two functions. First, it serves as a means for retaining the drain plug 40 about the shaft portion of the drain plug wrench 14. In this capacity, the key ring 34 acts as a stopper to prevent the drain plug 40 from sliding off the first end 18 of the drain plug wrench 14. In other words, the key ring 34 functions to limit the displacement of the drain plug 40 about the first end 18. Second, the key ring 34 functions to facilitate the coupling of the drain plug wrench to other items, such as a floatation device, or in other words is a means for coupling. Obviously, the key ring may further couple one or more keys thereto. Other types of stoppers or stop means are contemplated herein, as well as other types of coupling means. As such, the key ring 34 is not intended to be limiting in any way. For example, FIG. 5 illustrates an alternative stop means in the form of a fixed stopper 136. Other types of stop means may include one or more biased buttons or pins operable with the drain plug wrench 14, a cotter pin, and others.

The drain plug wrench 14 may also comprise, at its second end 22, additional means for retaining the drain plug 40 about the shaft portion of the drain plug wrench 14. In the exemplary embodiment shown, an additional means for retaining is present and comprises a biased stopper 30, such as those commonly known in the art, that is configured to retract under pressure, such as upon inserting the drain plug wrench 14 through the bore 56 of the drain plug 40, and then snap back into place. Therefore, once the second end 22 of the drain plug wrench 14 passes a sufficient distance through the bore 56 of the drain plug 40, the biased stopper 30 functions to snap back into place to provide a limiting function with respect to the position of the drain plug 40, at least about the second end 22 of the drain plug wrench. The biased stopper 30 serves at least two purposes. First, the biased stopper 30 helps to prevent the drain plug wrench 14 from inadvertently sliding back through the bore 56 of the drain plug 40 during operation or use. Second, a stated, the biased stopper 30 functions to retain the drain plug 40 on the shaft of the drain plug wrench 14 once the drain plug 40 has been removed from the drain hole insert 60, and to limit its movement about the second end 22. Indeed, once the drain plug 40 is removed from the drain hole insert 60, assuming the drain plug 40 remains releasably coupled or supported about the drain plug wrench 14, the drain plug 40 is able to slidably displace along the shaft of the drain plug wrench 14 in a bi-directional manner between the key ring 34 and the biased stopper 30. As such, the configuration of the drain plug wrench 14 illustrated in FIG. 1 comprises one exemplary means for retaining a drain plug once removed from the drain hole insert 60 or an appropriately configured drain opening 84. This concept is discussed in greater detail below with reference to FIG. 3.

The drain plug 40 is shown as a garboard-type drain plug comprising an upper head 44 having a bore 56 formed therein. The upper head 44 of the exemplary drain plug 40 comprises a block-like structure. The drain plug 40 further comprises a lower body portion 48 formed with the upper head 44. The lower body portion 48 comprises a series of threads 52 extending along the sidewalls of the lower body portion 48. These threads 52 correspond to and are configured to mate with the threads in the threaded bore 76 formed within the drain hole insert 60.

The drain hole insert 60 comprises a base flange 64 having a plurality of mounting holes 72 formed therein for facilitating attachment or mounting means to be inserted therethrough for the purpose of securing or mounting the drain hole 60 to the transom 80 of the boat. Extending outwardly from the rear of the base flange 64 is an insert or sleeve 68, which comprises along its interior sidewall a series of threads, thus forming at least a portion of the threaded bore 76. The sleeve 68 is sized and configured to fit through the drain opening 84 so that the rear of the base flange 64 rests flush against the surface of the transom 80. It is also contemplated by the present invention that the drain opening 84 may comprise a suitable threaded inner surface or other configuration commonly known in the art configured to receive the drain plug 40 directly therein, thus eliminating the need for a drain hole insert, such as the one shown. It is noted herein, that the drain plug 40 and the drain hole insert 60, as shown and described in FIG. 1, are not meant to be limiting in any way. Indeed, one ordinarily skilled in the art will recognize that the present invention drain plug retention system may be incorporated or applied to other configurations or designs of both drain plugs and drain hole inserts, as well as the actual drain opening 84 formed in the transom 80 of the boat. For instance, the drain plug 40 may comprise different sizes and shapes other than those specifically shown in the figures and described herein.

The present invention drain plug retention system 10 further comprises a floatation device 90, configured to function or operate as means for retaining or storing the drain plug wrench 14 and/or the drain plug wrench 14/drain plug 40 combination once the drain plug 40 is removed from the drain hole insert 60 (or from the drain opening 84 in the absence of a drain hole insert). As shown, the floatation device 90 comprises a portable floatation device that may be attached to a key ring 102, similar to those known in the art. Formed within the floatation device 90 is an aperture or bore 94 sized and configured to removably receive and secure the drain plug wrench 14 therein, with or without the drain plug 40. In the exemplary embodiment illustrated in FIG. 1, the bore 94 comprises a longitudinal bore having a circular cross section configured to correspond to the circular cross section of the shaft of the exemplary drain plug wrench 14 also illustrated in FIG. 1. The floatation device 90 is sized and configured to releasably receive and support the drain plug wrench 14, which may also have slidably supported thereon the drain plug 40.

As illustrated by the dotted lines having arrow indicators, the second end 22 of the drain plug wrench 14 is inserted into the longitudinal bore 94 formed within the floatation device 90. Moreover, as the drain plug 40 is slidably retained about the shaft of the drain plug wrench 14, the drain plug 40 may be positioned either near or about the first end 18 or near or about the second end 22 of the drain plug wrench 14 upon the drain plug wrench 14 being inserted into and supported by the floatation device 90. For example, the drain plug 40 may be positioned about the first end 18 (e.g., juxtaposed to the key ring 34) prior to the drain plug wrench 14 being inserted into the bore 94 of the floatation device 90. In this configuration, the drain plug 40 would be situated between the key ring 34 of the drain plug wrench 14 and an adjacent end portion of the floatation device 90 upon the drain plug wrench 14 being properly inserted into the bore 94 and retained within the floatation device 90. Alternatively, the drain plug wrench 14 may be first inserted into and through the longitudinal bore 94 of the floatation device 90 and the drain plug 40 subsequently inserted onto the shaft of the drain plug wrench 14 to be positioned about the second end 22, thus being situated between an opposing adjacent end of the floatation device 90 and the biased stopper 30 and retained by these elements. In any event, the floatation device 90 functions to retain and support the drain plug wrench 14 and the drain plug 40 as supported thereon.

The floatation device 90 may comprise any material or composition of materials giving the floatation device 90 the buoyancy properties needed to enable the floatation device 90 to still float when support the additional drain plug wrench 14 and drain plug 40 components. Such materials are commonly known in the art and are not specifically described herein. In addition, the size and shape of the floatation device 90 may be any desired.

Although the bore 94 formed within the floatation device 90 comprises a securing element to secure or hold the drain plug wrench 14 therein, the floatation device 90 further comprises means for coupling the drain plug wrench 14 to prevent the drain plug wrench 14 from inadvertently separating or releasing from the floatation device 90. In the exemplary embodiment shown in FIG. 1, means for coupling the drain plug wrench 14 comprises a clip 110 configured to releasably couple the key ring 34 of the drain plug wrench 14. The clip 110 is coupled to the floatation device 90 via a key ring 106 that is, in turn, coupled to the key chain 102. The key chain 102 couples to the floatation device 90 through a bore 98 formed laterally within the floatation device 90. The key chain 102 may comprise any length, but should not be too long to allow the drain plug wrench 14 to release from the floatation device 90. Essentially, once the drain plug wrench 14 is inserted into the bore 94 of the floatation device 90, the clip 110 may be actuated to engage the key ring 34 of the drain plug wrench 14, thereby securing it in place and preventing its removal or separation from the floatation device 90 until desired. The clip 110 may comprise any type of clip or other similar attachment device commonly known in the art.

Although FIG. 1 illustrates means for coupling the drain plug wrench 14 as comprising a clip 110, the present invention is not limited to this in any way. For example, in another aspect or exemplary embodiment, the key chain 102 coupled to the floatation device 90 may comprise a sufficient length and configuration to extend to and couple directly the key ring 34 of the drain plug wrench 14. Still other means for coupling the drain plug wrench 14 are contemplated by the present invention. Indeed, the present invention contemplates any type of means capable of coupling the drain plug wrench 14 to the floatation device 90.

Figure 2:
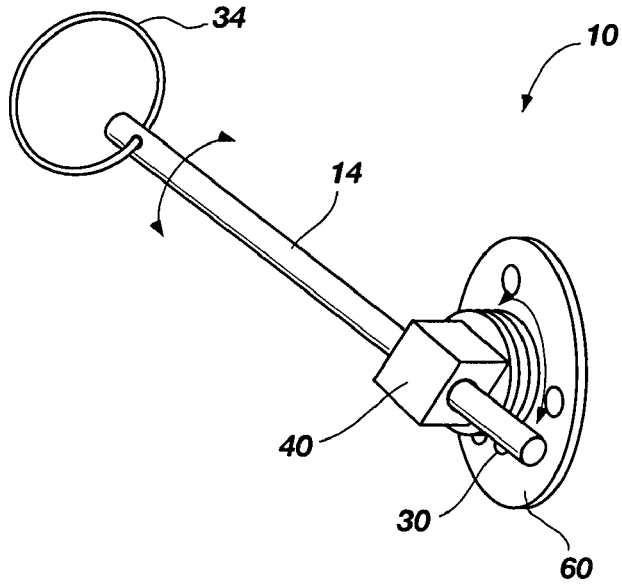
FIG. 2 illustrates a perspective view of the crank or drain plug wrench of the drain plug retention system illustrated in FIG. 1, as inserted into an aperture formed in a drain plug.

FIG. 2 illustrates a perspective view of the exemplary drain plug wrench 14 described above and shown in FIG. 1 in operation to either remove or replace or secure the drain plug 40 to the drain hole insert 60. Specifically, FIG. 2 illustrates the drain plug 14, and more particularly the second end 22 as inserted through the bore 56 of the drain plug 40. As so engaged, the drain plug wrench 14 functions as a crank arm for facilitating the removal and/or replacement or securing of the drain plug 40. Once the drain plug wrench 14 is inserted through the bore of the drain plug 40, it can be rotated in either direction to induce a corresponding rotation of the drain plug 40 within the drain hole insert 60. Thus, the drain plug wrench 14 may be rotated to either screw or unscrew the drain plug 40 with the respect to the drain hole insert 60. Obviously, the shaft of the drain plug wrench 14 may comprise any length, but will typically be between 4 and 6 inches long. FIG. 2 further illustrates the biased stopper 30, which functions to help retain the drain plug wrench 14 within the bore 56 of the drain plug 40 during rotation.

Figure 3:
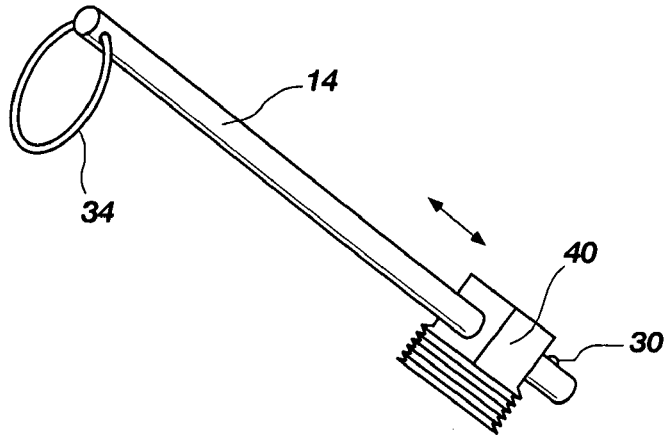
FIG. 3 illustrates a perspective view of the crank or drain plug wrench of the drain plug retention system illustrated in FIG. 1, as removably coupling and securing the drain plug.

With reference to FIG. 3, illustrated is a perspective view of the drain plug 40 slidably coupled to the drain plug wrench 14. As shown the drain plug 40 is capable of sliding bi-directionally back and forth along the shaft of the drain plug wrench 14 between the key ring 34 and the biased stopper 30. In this configuration, the drain plug wrench 14 is somewhat akin to a key fob in that the drain plug wrench 14, and more particularly the key ring 34 coupled thereto, can be used to hold one or more keys, such as the ignition keys to the boat, thereby allowing the drain plug wrench 14 and the drain plug 40 retained thereon to be grouped with the boat ignition keys, and thereby allowing the drain plug 40 to be located in a place or proximity noticeable to the boat owner. This is especially true when the boat owner proceeds to operate the boat. With the drain plug 40 attached to the drain plug wrench 14, and with these grouped with the boat ignition keys and inserted into the ignition, the drain plug 40 becomes more readily observable by the boat owner, thus increasing the chance the boat owner will notice and acknowledge the drain plug 40 and remember to replace or secure the drain plug 40 with respect to the drain hole insert prior to taking any actions in operating the boat, and especially launching the boat. Likewise, when removing the boat from the water and shutting the boat off, the boat owner is more likely to notice the drain plug wrench 14 as supported on the key ring 34 and to remember to remove the drain plug 41 for the purpose of draining the bilge water from the boat.

Figure 4:
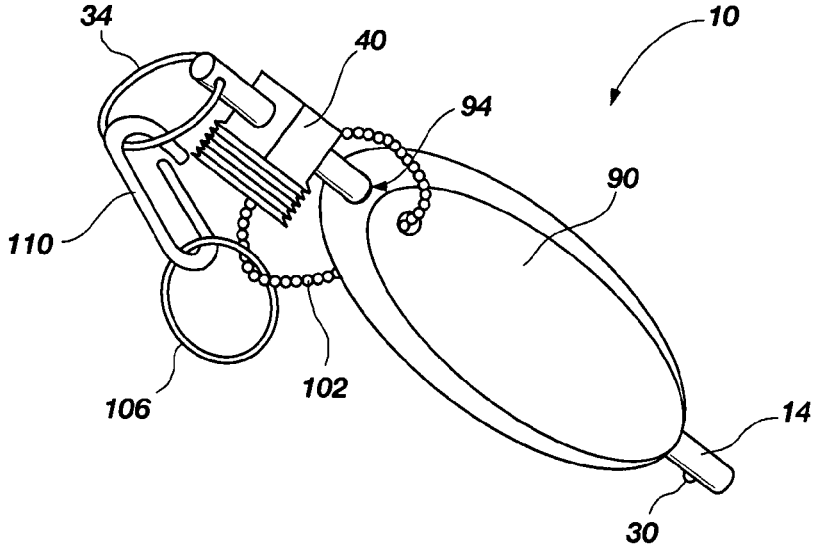
FIG. 4 illustrates a perspective view of the drain plug retention system of FIG. 1 as assembled according to one exemplary assembly configuration.

With reference to FIG. 4, illustrated is a perspective view of the various components or elements of the exemplary drain plug retention system 10 described above and shown in FIG. 3. Specifically, FIG. 4 illustrates the drain plug 40 as being retained by the drain plug wrench 14 and positioned about the first end 18 of the drain plug wrench 14. As discussed above, the drain plug 40 may be situated between the key ring 34 and a first end of the floatation device 90, or, in another exemplary assembly configuration, the drain plug 40 may be situated about the second end 22 of the drain plug wrench 14 between an opposite end of the floatation device 90 and the biased stopper 30. Once the drain plug wrench 14 is inserted into or otherwise retained by the floatation device 90, means for coupling the drain plug wrench may be actuated. In the embodiment shown in FIG. 4, the clip 110 secured to the key chain 102 of the floatation device 90 via key ring 106 is operated to releasably couple the key ring 34 of the drain plug wrench 14. The clip 110 as releasably coupled to the key ring 34 prevents the drain plug wrench 14 from being removed from the floatation device 90 due to the length of the shaft of the drain plug wrench 14 being longer than the allowable play in the various coupled key rings and/or key chains. Thus, in order to remove the drain plug wrench 14 from the floatation device 90, the clip 110 must be disengaged from the key ring 34. Similar to the embodiment described in FIG. 3, the drain plug retention system assembly shown in FIG. 4 may also be grouped with the boat keys in order to make the keys as well as the drain plug 40 more readily viewable by the boat owner. The addition of the floatation device 90 provides enhanced safety features in that any inadvertent or accidental dropping of the drain plug retention system 10 into the water will not result in the sinking and ultimate loss of the boat keys, any other additional keys attached thereto, the drain plug wrench 14, or the drain plug 40 itself. Because of the buoyant properties of the floatation device 90, the entire drain plug retention system 10 will float, thus allowing the entire system to be easily retrieved.

With reference to FIG. 5, illustrated is a drain plug retention system according to another exemplary embodiment of the present invention. Specifically, FIG. 5 illustrates the drain plug retention system as comprises an alternatively configured drain plug wrench, shown as drain plug wrench 114. In this embodiment, the drain plug wrench 114 comprises as fixed stopper 136 located about the first end 118 of the drain plug wrench 114. Opposite this, at the second end 122 of the drain plug wrench 114 is a biased stopper 130, similar to the one described above and shown in FIGS. 1-4. The fixed stopper 136 shown in FIG. 5 comprises lateral elements extending perpendicular from the shaft of the drain plug wrench 114. However, the rigid stopper may comprise other configurations, such as an annular ring or ridge formed about the circumference of the shaft. The drain plug wrench 114 is also configured to be inserted into a corresponding bore located within the floatation device 90 in a similar manner as discussed above. In operation, the drain plug 114 is inserted into the floatation device 90 until an end of the floatation device 90 abuts the fixed stopper 136, as shown. The drain plug 40 may then be inserted over the second end 122 and positioned between the opposite end of the floatation device 90 and the biased stopper 130. Alternatively, the drain plug 40 may be inserted onto the drain plug wrench 114 prior to the drain plug wrench 114 being inserted into the bore of the floatation device 90. In this arrangement, the drain plug 40 will be located or situated between the fixed stopper 136 and the proximate end of the floatation device 90. As in other embodiments, the drain plug retention system may further comprise one or more key chains and/or key rings, shown in FIG. 5 as key chain 102 and key ring 106.

Figure 6:
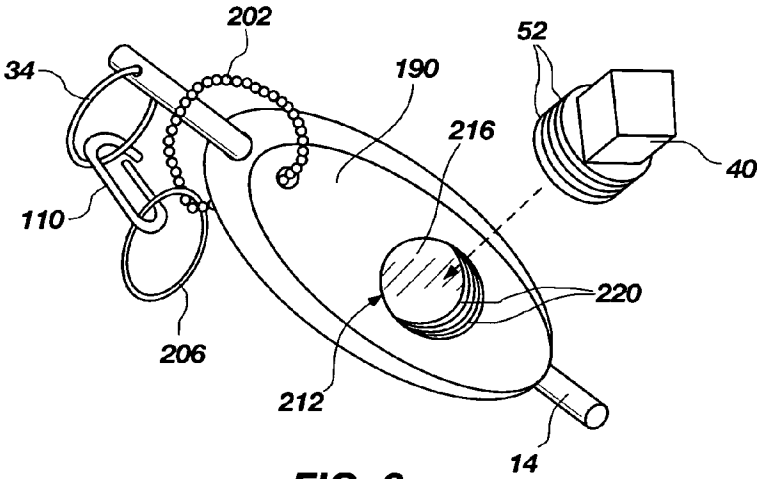
FIG. 6 illustrates a perspective view of an assembled drain plug retention system according to still another exemplary embodiment of the present invention.

With reference to FIG. 6, illustrated is a perspective view of a drain plug retention system according to another exemplary embodiment of the present invention. In this embodiment, the drain plug retention system comprises a drain plug wrench 14 similar to the drain plug wrench described above with reference to FIG. 1, and a alternatively configured floatation device 190 configured to receive the drain plug wrench 14, as discussed above. The floatation device 190 a recess 212 formed therein, wherein the recess 212 is configured to receive and support a sleeve 216 having a threaded inner sidewall comprising threads 220. The threads 220 correspond to and mate with threads 52 located on the sidewall of the drain plug 40. As such, once the drain plug 40 is removed from the drain hole insert, it may be temporarily retained and stored within the sleeve 216 of the floatation device 190. The drain plug retention system may further comprise means for coupling the drain plug wrench 14 to the floatation device 190 using similar means as discussed above such as the clip 110 as coupled to the key ring 34 and also the key ring 206 or key chain 202.

Figure 7C:
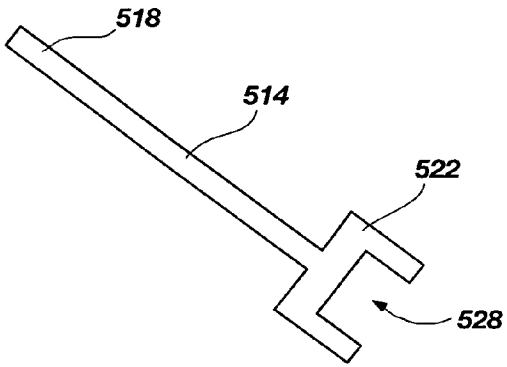
FIG. 7-A illustrates a perspective view of a drain plug wrench comprising an alternative configuration.
Figure 7A:
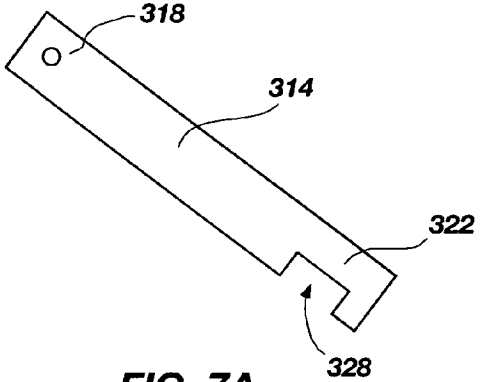
Figure 7B:
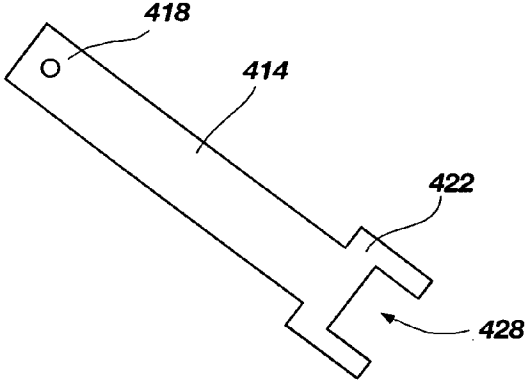

FIG. 7-A illustrates a drain plug wrench 314 according to another exemplary embodiment of the present invention. In this embodiment the drain plug wrench 314 comprises a first end 318 and a second end 322, wherein the second end 322 comprises a recess portion 328 sized and configured to mate with the upper head portion of a standard drain plug. FIG. 7-A illustrates a drain plug wrench as comprises an alternative configuration. Although different in shape than the drain plug wrench described above, the drain plug wrench 314 is configured to comprise all of the advantages as discussed herein with respect to any of the other embodiments. For example the drain plug retention system may comprise a floatation device having a bore formed therein having a cross section complimentary to that of the drain plug wrench 314, thereby allowing the drain plug wrench 314 to be retained and supported within the floatation device 190. An additional advantage of the drain plug wrench 314 of FIG. 7-A, is that the wrench may be used on a standard drain plug. In other words, many boats comprise a drain plug without a bore formed in their upper head. The drain plug wrench 314 accommodates the standard drain plugs, without modification to be made to the drain plug, or a different drain plug used altogether.

The drain plug wrench 314 is particularly well suited for use within a drain plug retention system comprising a floatation device, such a the floatation device discussed above in reference to FIG. 6, since the drain plug wrench 314 itself has no way of retaining and supporting the drain plug thereon.

FIG. 7-B illustrates a drain plug wrench 414 according to still another exemplary embodiment of the present invention. The drain plug wrench 414 comprises a first end 418 and a second end 422 having a longitudinally oriented recess 428, that functions similar to the recess 328 described above and shown in FIG. 7-A. The advantages and functions of the drain plug wrench 414 are similar to those of the drain plug wrench 314 of FIG. 7-A, and thus the description of the drain plug wrench 314 is incorporated herein, where applicable.

FIG. 7-C illustrates a drain plug wrench 514 according to still another exemplary embodiment of the present invention. In this embodiment, the drain plug wrench 514 comprises a first end 518 and a second end 522. In addition, the drain plug wrench 514 comprises a cylindrical shaft portion integrally formed with a flattened portion having a recess 528 formed therein, wherein the recess 528 is configured to receive the upper head of a corresponding drain plug. The drain plug wrench 514 combines many features of the drain plug wrench discussed above and shown in FIGS. 1-4 with those discussed in FIG. 7-B.

The present invention drain plug retention system comprises several advantages over prior related systems. First, as with some embodiments, the drain plug may be removed and secured directly to the wrench for temporary storage of the drain plug. Second, the drain plug and drain plug wrench, as coupled together, may be further removably coupled to a floatation device for increased safety. Third, the coupled drain plug, drain plug wrench, and the floatation device may be grouped with one or more boat ignition keys to allow the drain plug to remain in a highly visible area proximate the boat owner. For example, the ignition keys to a boat are typically kept track of when not in operation to start and run the boat. Thus, when the boat owner attempts to locate the boat ignition keys for the purpose of operating the boat, the presence of the drain plug in the drain plug retention system as grouped with the boat ignition keys will serve as a reminder to the boat owner or user to restore and secure the drain plug to the drain hole prior to launching the boat. Likewise, if the drain plug is not present, the boat owner is still reminded to at least ensure the drain plug is in place due to the presence of the remaining components of the system grouped with the boat ignition keys, such as the drain plug wrench as inserted into the floatation device. In a similar manner, upon ceasing operation of and removing the boat from the water, the presence of the elements of the present invention as grouped with the boat ignition keys will function to remind the boat owner to remove the drain plug and purge the bilge water. Fourth, the buoyancy properties of the floatation device ensure that the drain plug will not be lost due to sinking.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. A drain plug retention system comprising:

a drain plug configured to open and close a drain hole located in the transom of a boat;

a drain plug wrench configured to facilitate the removal and restoration of said drain plug with respect to said drain hole;

a floatation device, independent of said drain plug wrench, configured to receive and to buoyantly support said drain plug wrench and said drain plug; and means for coupling said floatation device to said drain plug wrench to prevent inadvertent separation of said drain plug wrench from said floatation device.

2. The drain plug retention system of claim 1, wherein said means for coupling comprises a clip configured to engage a key ring located on said drain plug wrench.

3. The drain plug retention system of claim 1, wherein said means for coupling comprises a key chain.

4. The drain plug retention system of claim 1, further comprising means for grouping at least one of said drain plug, drain plug wrench, and floatation device with a boat ignition key.

5. The drain plug retention system of claim 1, wherein said drain plug wrench comprises a shaft portion configured to be inserted into at least one bore formed in said drain plug.

6. The drain plug retention system of claim 1, wherein said drain plug wrench comprises a recess formed therein and configured to engage an upper head portion of said drain plug.

7. The drain plug retention system of claim 1, wherein said drain plug wrench further comprises means for retaining said drain plug once removed from said drain hole.

8. The drain plug retention system of claim 7, wherein said means for retaining comprises a stopper located about a first end of said drain plug wrench, and a biased stopper located about a second end of said drain plug wrench, said stoppers operating to contain said drain plug about said drain plug wrench.

9. The drain plug retention system of claim 7, wherein said floatation device further comprises means for retaining said drain plug.

10. The drain plug retention system of claim 9, wherein said means for retaining comprises a recess formed within said floatation device and an insert fittable within said recess configured to receive said drain plug.

11. The drain plug retention system of claim 9, wherein said drain plug comprises an upper head portion having a bore formed therethrough, and a lower threaded portion, said bore configured to receive said drain plug wrench to facilitate removal and securing of said drain plug.

12. A drain plug retention system comprising:

a drain plug configured to open and close a drain hole located in the transom of a boat;

a drain plug wrench configured to facilitate the removal and securing of said drain plug with respect to said drain hole, said drain plug wrench further comprising an elongate shaft, and means for removably coupling and retaining said drain plug about said elongate shaft once removed from said drain hole; and means for grouping said drain plug wrench and retained drain plug with a boat key to increase the locality of said drain plug and to remind a boat user of the whereabouts and status of said drain plug.

13. A drain plug retention system for retaining a drain plug configured to open and close a drain hole located in the transom of a boat, said retention system comprising:

a floatation device;

a recess formed in said floatation device; and a threaded insert fittable within said recess, said threaded insert comprising a threaded opening that corresponds to a threaded portion of said drain plug, and that releasably engages and retains said drain plug once removed from a drain hole of a boat and screwed into said threaded opening.

14. A method for reminding a boat owner of the status of a drain hole of a boat, said method comprising:

providing a drain hole formed in a transom of said boat;

providing a drain plug configured to open and close said drain hole;

facilitating the removal of said drain plug using a drain plug wrench;

supporting said drain plug about a floatation device independent of said drain plug wrench; and coupling said floatation device to said drain plug wrench to prevent inadvertent separation of said drain plug wrench from said floatation device.

15. The method of claim 14, further comprising grouping said drain plug and said floatation device with at least one boat ignition key.

16. The method of claim 14, wherein said supporting comprises releasably coupling said drain plug to said drain plug wrench and subsequently supporting said drain plug wrench and said drain plug about said floatation device.

17. The method of claim 14, wherein said supporting comprises releasably coupling said drain plug directly to said floatation device.

* * * * *